US007497737B2

(12) United States Patent
Mikolajczak et al.

(10) Patent No.: US 7,497,737 B2
(45) Date of Patent: Mar. 3, 2009

(54) SUBMINIATURE ELECTRICAL CONNECTOR INCLUDING OVER-VOLTAGE AND OVER-CURRENT CIRCUIT PROTECTION

(75) Inventors: Adrian Pawel Mikolajczak, Los Altos, CA (US); Scott Anthony Shuey, Harrisburg, PA (US); Eric David Briant, Dillsburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/974,780

(22) Filed: Oct. 16, 2007

(65) Prior Publication Data

US 2008/0096429 A1 Apr. 24, 2008

Related U.S. Application Data

(60) Provisional application No. 60/852,813, filed on Oct. 19, 2006.

(51) Int. Cl.
*H01R 33/95* (2006.01)

(52) U.S. Cl. ..... 439/622

(58) Field of Classification Search ..... 439/622, 439/490, 607, 608, 95, 108; 361/119
See application file for complete search history.

(56) References Cited

U.S. PATENT DOCUMENTS 5,195,015 A * 3/1993 Kaczmarek ..... 361/119
6,217,378 B1 4/2001 Wu
6,217,389 B1 4/2001 Jatou
6,518,731 B2 2/2003 Thomas et al.

OTHER PUBLICATIONS

Tyco Electronics Application, Application Note, PolyZen-USB Peripheral Protection; 2006; RCP00xx.0806.xxx.

* cited by examiner

*Primary Examiner*—Chandrika Prasad

(57) ABSTRACT

A Micro-B USB electrical connector socket includes a metal shell, a plastic body and an array of formed and aligned discrete conductor leads encapsulated in the body. The leads include a power supply lead, a power return lead, and at least two data differential signal leads. Each lead has a connector pin portion at one end and a circuit connector portion at an opposite end. The plastic body encapsulates unexposed portions of the plurality of discrete conductor leads and includes an over-current circuit protection element such as a PPTC thermistor and an over-voltage circuit protection element such as a zener diode in thermal contact with the PPTC thermistor in order to accelerate heating thereof to a tripped state during a circuit protection event. The metal shell surrounds and mounts the plastic body to register the plastic body and connector pin portions in a predetermined alignment. The socket is fully compliant with size and configuration requirements of the Micro-B USB specification for sockets not having internal, thermally-coupled over-voltage and over-current protection elements.

20 Claims, 8 Drawing Sheets

SUBMINIATURE ELECTRICAL CONNECTOR INCLUDING OVER-VOLTAGE AND OVER-CURRENT CIRCUIT PROTECTION

CROSS-REFERENCE TO RELATED APPLICATIONS

This application claims the benefit of U.S. Provisional Application No. 60/852,813 filed Oct. 19, 2006.

BACKGROUND OF THE INVENTION

1. Field of the Invention

The present invention relates to the field of electrical connectors, and in particular to a miniaturized Universal Serial Bus (USB) connector socket, such as a Micro-B USB socket, and providing therein thermally-coupled over-current and over-voltage circuit protection elements.

2. Introduction to the Invention

Standardized plug and socket connectors are widely employed in the electrical and electronic arts. One example, the Universal Serial Bus (USB), is a widely recognized and followed connectivity specification that was first developed in 1995 by technology companies. The USB specification provides an interconnect mechanism which includes transfer of serial data as well as operating power via standard form electrical connectors. By the USB specification a USB-compliant power supply will provide a peripheral device with a fixed voltage in a range of 4.75 and 5.25 Volts with current of at least 0.5 Amperes. The USB specification has evolved with the general trend toward electronic circuit miniaturization, and has specified a Mini-B USB connector plug and socket to handle miniature peripheral devices such as digital cameras, PDAs, and hand-sets, for example; see USB 2.0 Specification ECN #1: Mini-B Connector, Oct. 20, 2000. More recently the even smaller Micro-B USB connector plug and socket have been proposed.

While USB has provided ease of use, expandability, and speed for the end user and has resulted in widespread adoption and use in countless personal computing, consumer electronics, and mobile devices, the success of this standard has increased the likelihood of over-voltage/over-current electrical fault conditions. Electrical faults are known to occur, making unprotected downstream electronics devices susceptible to damage. Typical over-voltage/over-current faults include inductively induced voltage spikes, voltage spikes from intermittent connections (defective cords or dirty/corroded contacts) and/or over-voltage charger connections resulting from component failure or user error (plugging in the wrong charging unit, for example). Less typical but possible faults include reversal of voltage supply polarity. Because USB has become such a ubiquitous power-charging interface, some vendors have supplied AC to DC converters with a USB output connector. These converters may have unknown, inadequate, or non-existent voltage regulation and transient-suppression characteristics. Unprotected devices may be damaged by over-voltage/over-current conditions when connected to such unregulated converters having standardized connectors, such as a USB connector plug. While the USB standard strongly recommends inclusion of an over-current protection element, such as a fuse, as part of each peripheral appliance having a USB connector socket, separate over-current protection elements take up printed circuit board space and may not be conveniently accessed by the user for replacement or reset. Examples of USB connector sockets may be found in U.S. Pat. No. 6,217,378 (Wu) for "Universal Serial Bus Connector", and U.S. Pat. No. 6,217,389 (Jatou) for "Universal Serial Bus Connector with Integral Over-current Protection Device and Indicator". While the Jatou '389 patent suggests including a resettable fuse within a USB connector socket, there is no teaching or suggestion as to how one might effectively combine thermally-coupled over-voltage and over-current protection elements within a USB connector socket, much less a much smaller Micro-B USB connector socket.

Discrete over-voltage and over-current protection elements for electrical circuits are well known. Known over-voltage circuit protection elements include reverse avalanche breakdown diodes, zener diodes, transient voltage suppression diodes, thyristors, multilayer varistors, gas plasma ionization devices, and Schottky diodes, whether alone or combined with other circuit elements such as pass transistors and operational amplifiers, for example. Known over-current circuit protection elements include metallic fuses, thermally activated circuit breakers, and thermistors. As used herein, the term "thermistor" includes resistors which vary in resistance as a function of temperature. One known example of an over-current protection element is the polymeric positive temperature coefficient (PPTC) thermistor.

Devices exhibiting a positive temperature coefficient of resistance effect are well known and may be based on certain ceramic materials, e.g., barium titanate, or conductive polymer compositions comprising a polymeric matrix component and a particulate conductive filler material dispersed within the polymer matrix. At relatively low, ambient temperatures the PPTC thermistor has a low electrical resistance, on the order of a few Ohms or less. However, when the PPTC thermistor is exposed to a high temperature resulting from ohmic heating, for example, the polymeric matrix expands and separates the conductive particulates, resulting in a very high electrical resistance, often by as much as five or more orders of magnitude greater than the low temperature resistance. The temperature at which the PPTC thermistor transitions from low resistance to high resistance is known as the switching or "trip" temperature, $T_s$. When the PPTC thermistor cools to a temperature below the trip temperature, $T_s$, the polymeric matrix solidifies and shrinks, thereby returning the device to its low-resistance state. When used as an in-series over-current protection device, the PPTC thermistor is referred to as being "resettable", in that it trips to high resistivity when heated to the switching temperature, $T_S$, thereby decreasing current flow through the protected circuit. When the over-current condition is removed, the PPTC thermistor automatically resets to low resistivity when it cools to below $T_s$, thereby restoring a low ohmic path enabling full current flow through the protected circuit when electrical power is reapplied thereto.

By "PPTC" is meant a composition including a polymeric matrix and having an $R_{14}$ value of at least 2.5 and/or an $R_{100}$ value of at least 10, and it is preferred that the composition should have an $R_{30}$ value of at least 6, where $R_{14}$ is a ratio of resistivities at the end and beginning of a 14° C. range, $R_{100}$ is a ratio of resistivities at the end and beginning of a 100° C. range, and $R_{30}$ is a ratio of resistivities at the end and beginning of a 30° C. range. Generally, the compositions used in PPTC thermistor elements of the present invention show increases in resistivity which are much greater than these minimum values.

Suitable conductive polymer compositions and elements, and methods for producing the same, are disclosed for example in U.S. Pat. No. 4,237,441 (van Konynenburg et al.), U.S. Pat. No. 4,545,926 (Fouts et al.), U.S. Pat. No. 4,724,417 (Au et al.), U.S. Pat. No. 4,774,024 (Deep et al.), U.S. Pat. No.

4,935,156 (van Konynenburg et al.), U.S. Pat. No. 5,049,850 (Evans et al.), U.S. Pat. No. 5,250,228 (Baigrie et al.), U.S. Pat. No. 5,378,407 (Chandler et al.), U.S. Pat. No. 5,451,919 (Chu et al.), U.S. Pat. No. 5,747,147 (Wartenberg et al.) and U.S. Pat. No. 6,130,597 (Toth et al.), the disclosures thereof being expressly incorporated herein by reference thereto.

It is known to provide planar PPTC thermistors in electrical connection and thermal contact with electronic components such as zener diodes, metal oxide semiconductor field effect transistors (MOSFETs), and more complex integrated circuits forming voltage/current regulators, as exemplified by the teachings and disclosures set forth in commonly assigned U.S. Pat. No. 6,518,731 (Thomas et al.) (particularly FIGS. 45-47), the disclosure thereof being expressly incorporated herein by reference thereto. Also, see, for example, U.S. Pat. No. 3,708,720 (Whitney et al.), U.S. Pat. No. 6,700,766 (Sato) and U.S. Patent Publication 2004/0275046 (Morimoto et al.). While shunt protectors such as semiconductors and series protectors such as PPTC thermistors simultaneously respond to excessive electrical energy, one reason for combining semiconductor circuit protection devices with PPTC thermistors is that the semiconductor devices respond to over-voltage conditions at electronic speeds in microsecond ranges, whereas PPTC thermistors operate relatively much more slowly in reaching the switching temperature, $T_S$, generally measured in milliseconds. By thermally coupling the semiconductor device to the PPTC thermistor, heat first generated in the semiconductor device is rapidly transferred to the PPTC thermistor in order to accelerate heat rise to the switching temperature, $T_S$. While the foregoing patents show combinations of semiconductor devices and PPTC thermistor devices in thermal contact, those patents do not show or suggest inclusion of fully integrated over-voltage/over-current circuit protection elements inside standardized and highly miniaturized connector sockets, such as a Micro-B USB connector socket.

Miniaturized electrical connectors including connector sockets that conform to a standardized specification are constrained by size requirements and pin configurations such that it becomes difficult to include any additional electrical components, elements or devices within the size requirements and still maintain conformance with the standard connector/socket specification.

BRIEF SUMMARY OF THE INVENTION

One object of the present invention is to provide a miniaturized electrical connector including thermally-coupled over-voltage and over-current protection elements in a manner overcoming limitations and drawbacks of the prior art.

Another object of the present invention is to provide a miniaturized electrical connector socket that includes power supply and return lines wherein the socket includes circuitry connected between the power supply and return lines for protecting against over-voltage and over-current events.

Another object of the present invention is to provide over-current and over-voltage circuit protection for electronic equipment without requiring any circuit board space beyond that required for a miniature connector socket.

Another object of the present invention is to provide a readily manufacturable and simplified connector structure including thermally-coupled over-current and over-voltage circuit protection elements.

A further object of the present invention is to provide a miniature connector socket that conforms to a standardized connector specification, such as the specification for a Micro-B USB connector socket, and includes within the specified package outline additional circuit elements including a rapidly acting over-voltage circuit protection zener diode that is thermally-coupled to a slower acting over-current circuit protection PPTC thermistor in order to accelerate operation of the thermistor, thereby providing a drop-in replacement or substitute fully in conformance with the specification.

One more object of the present invention is to provide a connector socket with a premade and tested hybrid electronics circuit module comprising an over-current circuit protection element and an over-voltage circuit protection element connected thereto and in thermal contact therewith.

In accordance with principles and aspects of the present invention, an electrical connector, such as a surface-mountable Micro-B USB connector socket, comprises a plurality of discrete conductor leads including at least a power supply lead and a power return lead and at least one data signal lead, and most preferably at least two differential data signal leads, each lead including a connector pin portion at one end and a circuit connector portion at an opposite end. The connector further includes a plastic body encapsulating unexposed portions of the plurality of discrete conductor leads of a pin array and enclosing an over-current circuit protection element and an over-voltage circuit protection element. The over-current circuit protection element, such as a PPTC thermistor, is connected in series with the power supply lead to form a supply side portion and a load side portion. The over-voltage circuit protection element, such as a zener diode, is connected in shunt across the load side portion of the power supply lead and the power return lead and is also thermally coupled to the over-current circuit protection element in order to accelerate heating thereof to a tripped state during a circuit protection event. A formed sheet metal shell surrounds at least a portion, and preferably substantially all, of the plastic body and registers the plastic body and exposed portions of the pin array in a predetermined alignment. In one preferred embodiment the plurality of discrete conductor leads includes a first transverse mounting plate and a second transverse mounting plate with the over-voltage circuit protection element being mounted between the first and second mounting plates and with the over-current circuit protection element being mounted on an opposite side of the first transverse mounting plate exposed within a well defined by the plastic body. Most preferably, the well includes a peripheral space or channel surrounding the over-current protection element to provide room for thermal expansion occurring during an over-current event. In another preferred embodiment a single transverse mounting plate is defined, and the over-current circuit protection element is combined with the over-voltage circuit protection element as a hybrid electronic module and mounted to the single plate and electrically connected to leads or contact lands of the pin array within the well.

These and other objects, advantages, aspects and features of the present invention will be more fully understood and appreciated upon consideration of the detailed description of preferred embodiments presented in conjunction with the following drawings.

BRIEF DESCRIPTION OF THE DRAWINGS

The invention is illustrated by the drawings in which.

DETAILED DESCRIPTION OF THE INVENTION

Figure 1:
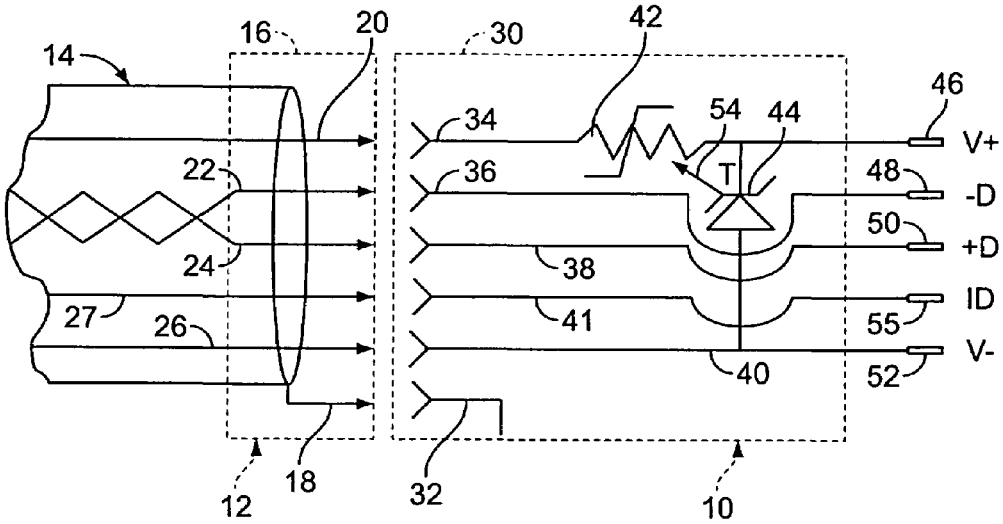
FIG. 1 is an electrical schematic diagram of a miniature power/data connector plug, and a mating socket having integrated over-voltage and over-current protection elements in accordance with principles of the present invention.

With reference to FIG. 1, an exemplary electrical connector assembly including a socket 10 and a mating plug 12 is shown diagrammatically. In this preferred example the socket 10 and plug 12 are in accordance with the Micro-B USB connector specification and provide power supply and return lines, differential data signal lines and an extra line, provided for example to identify the peripheral device of which the socket 10 is a part. The exemplary plug 12 extends from a distal end of a shielded electrical multi-conductor cable 14 and includes a molded plug housing comprising an electrical shield 16 forming a cable shield connection 18 connected to the electrical shield of the cable, and five connector pins 20, 22, 24, 26 and 27. In this particular arrangement, cable shield connection 18 interconnects the cable shield and the plug electrical shield 16, connector pin 20 connects to an electrical power supply wire, connector pins 22 and 24 connect to a differential data signal twisted pair, connector pin 26 connects to a power and signal ground return reference wire, and connector pin 27 connects to an optional ID wire. A non-illustrated other end of the cable 14 typically connects to a power and signal source, either through another USB plug, or directly.

The exemplary Micro-B USB socket 10 includes an electrical shield 30 and shield connection 32 for electrically connecting to the cable shield connection 18 of a compatible plug 12. The socket 10 also includes a power supply pin 34 for connecting to pin 20, two differential signal pins 36 and 38 for connecting to the data pin pair 22 and 24, a data signal and power return pin 40 for connecting to plug pin 26, and a peripheral ID pin 41 for connecting to the connector pin 27. While FIG. 1 diagrams the plug 12 as having pins and the socket as having receptacles, in practice both plug and socket contacts include aspects of pins and receptacles, as is well known and understood in the USB art.

In accordance with aspects of the present invention, an over-current device 42 and an over-voltage device 44 are integrated into and included within the plug 10. The over-current device 42 is connected in series between the power supply pin 34 and a socket connection lead 46. The over-voltage device 44 is connected in shunt across the connection lead 46 and a ground return lead 52 which in turn extends from the data signal and power return pin 40. Most preferably, the over-current device 42 is a PPTC thermistor, and the over-voltage device 44 is a high speed electronic device, most preferably a zener diode (as used herein "zener diode" includes a reverse breakdown avalanche diode). While a zener diode is presently preferred, other voltage-limiting electronic circuit elements are clearly within the contemplation of the present invention. Because the over-voltage device 44 responds to over-voltage conditions very rapidly, on the order of microseconds or faster, heat is quickly generated in the electronic device 44. This heat is thermally coupled via a heat transfer medium 54, denoted by the arrow labeled T in FIG. 1, to the PPTC thermistor 42 in order to raise its temperature and accelerate its trip to a high resistance state. The socket 10 also includes connection leads 48 and 50 respectively connecting to the two differential signal pins 36 and 38 and a connection lead 55 connecting to the peripheral ID pin 41. When a zener diode implements the over-voltage device 44, additional circuit protection is provided against reversed polarity of the power supply, since in the event of reversed polarity of the supply and return leads 34 and 40, the zener diode 44 will rapidly conduct and generate heat to aid tripping of the PPTC thermistor 42 in accordance with the diode's forward conduction characteristic.

Figure 2:
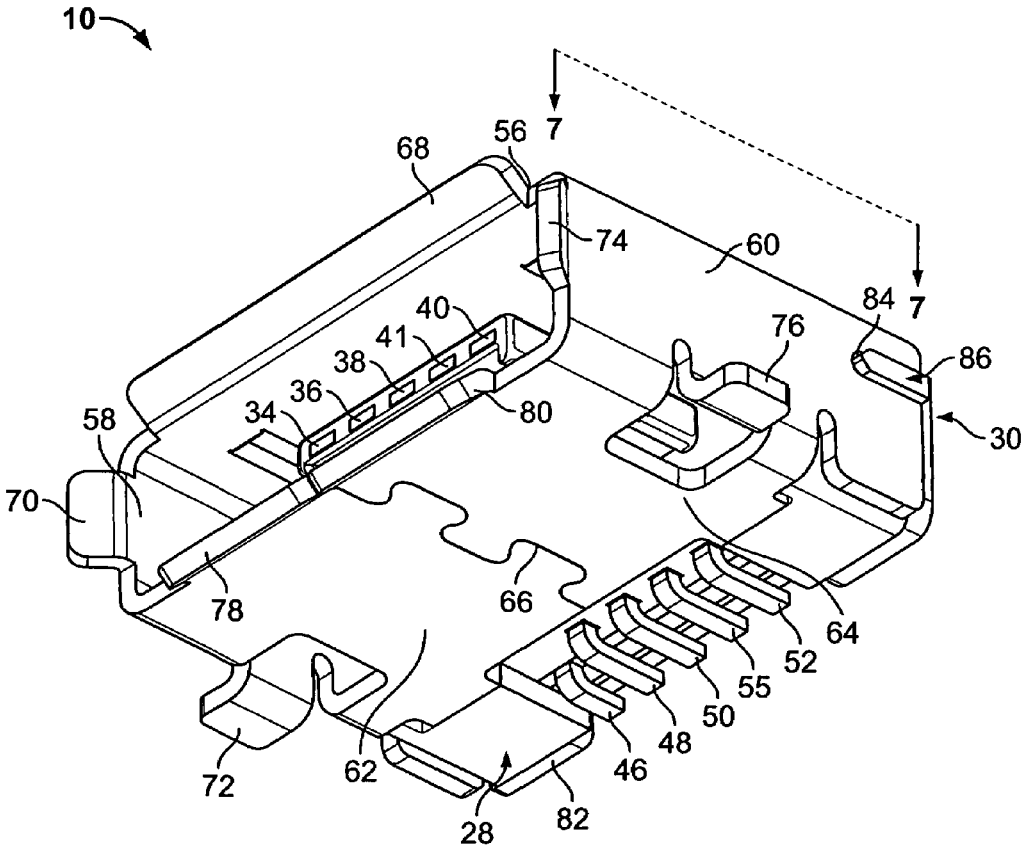
FIG. 2 is an orthogonal view in upward projection of one embodiment of a Micro-B USB connector socket incorporating principles of the present invention and showing the plug entry end, bottom side segments and right side of an outer shell.

FIG. 2 sets forth one presently preferred embodiment of the socket 10 in accordance with the present invention. In this embodiment the socket 10 includes a molded plastic body 28 (FIG. 3) incorporating a pin, connector and lead array 90 (FIGS. 4 and 5) held in place by the formed metal shield 30. A metal structure forming the shield 30 is most preferably formed by stamping and bending from a sheet of suitably thin sheet metal. As formed, the shell 30 includes a top wall 56 a left side wall 58, a right side wall 60, a left bottom wall segment 62, a right bottom wall segment 64 and a back wall 82. As formed the left bottom wall segment 62 and the right bottom wall segment 64 define complementary interlocking features 66 in the nature of a dove tail or puzzle piece arrangement for locking the two complementary bottom wall segments 62 and 64 together to form a locked, continuous bottom wall. The top wall 56 includes an outer flanged lip 68. The left side wall has an outer flanged lip 70 and surface mounting tab 72. The right side wall 60 in similar fashion includes an outer flanged lip 74 and a surface mounting tab 76. The bottom wall segments 62 and 64 respectively include outer flanged lip segments 78 and 80. The outer flanged lips 68, 70, 74 and lip segments 78 and 80 act to guide insertion of a compatible connector plug into mechanical and electrical engagement within the socket 10. Slot features 84 defined in side walls 58 and 60 function to receive protrusions or bosses 86 of the molded plastic body 28, thereby aiding in aligning and securing the plastic body 28 and its contact array 90 inside the shell 30.

As shown in FIG. 2, the pins 34, 36, 38 40, and 41, and the corresponding connection leads 46, 48, 50, 52, and 55, are formed within, and are positioned in the formed metal shell 30 by the plastic body 28. The leads 46, 48, 50, 52 and 55 are flattened and aligned to be parallel with a plug-insertion axis of the connector socket 10 to facilitate surface mounting and connection to aligned connection pads of a printed circuit substrate of electronic circuitry (not shown) to be protected against over-current and over-voltage conditions in accordance with the present invention. While a surface mounting arrangement with a plug-insertion axis parallel to the aligned circuit board connection leads 46, 48, 50, 52 and 55 is presently preferred, those skilled in the art will understand that the principles of the present invention are equally applicable to a miniaturized socket having thru-hole pins and mounting tabs, or other known mounting arrangements and orientations including ones normal to the facing surface of an underlying printed circuit board substrate.

Figure 3:
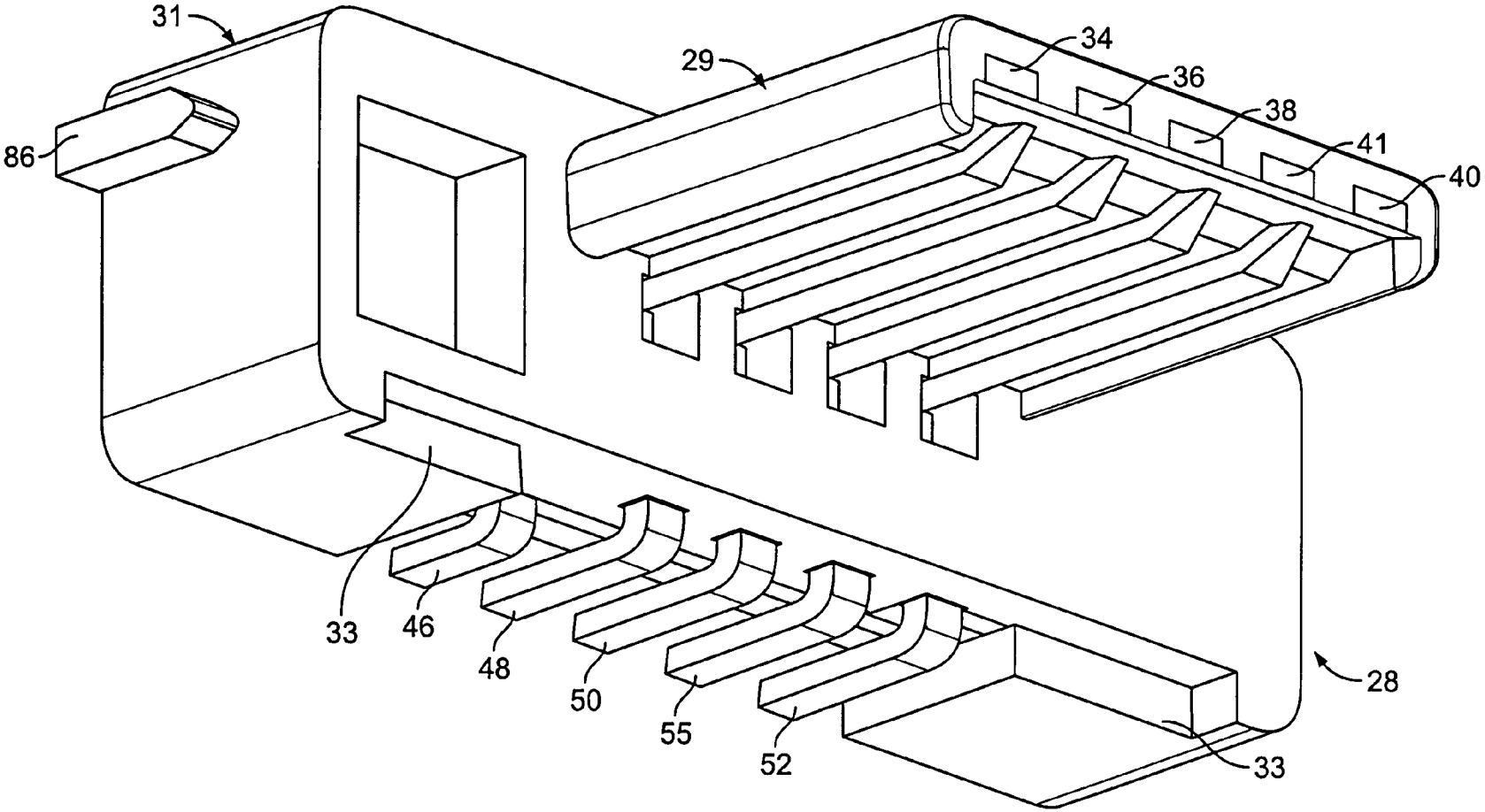
FIG. 3 is an orthogonal view in upward projection, showing a contact pin array molded into a plastic body of the FIG. 2 socket structure.

FIG. 3 illustrates one presently preferred form of the molded plastic body 28. The body 28 includes an elongated neck portion 29 extending from a generally rectangular body portion 31. Features such as recesses 33 and the bosses 86 enable the plastic body 28 to be securely and properly registered to and mounted within the metal shell 30 of the socket 10. Exposed portions of the pin, connector and lead array 90 (FIG. 4) define contact pins 34, 36, 38, 41 and 40, and also define flattened mounting tab ends of leads 46, 48, 50, 55 and 52 as shown in FIG. 3. The plastic body 28 is most preferably formed by injection molding over the pin, connector and lead array 90 in suitable thermoplastic molding apparatus. The body 28 is most preferably formed from a dielectric thermoplastic material, such as a minimum UL 94-V0 rated, 30 percent glass-filled polybutylene terephthalate (PBT) or polyethylene terephthalate (PET), or better, material.

Figure 4:
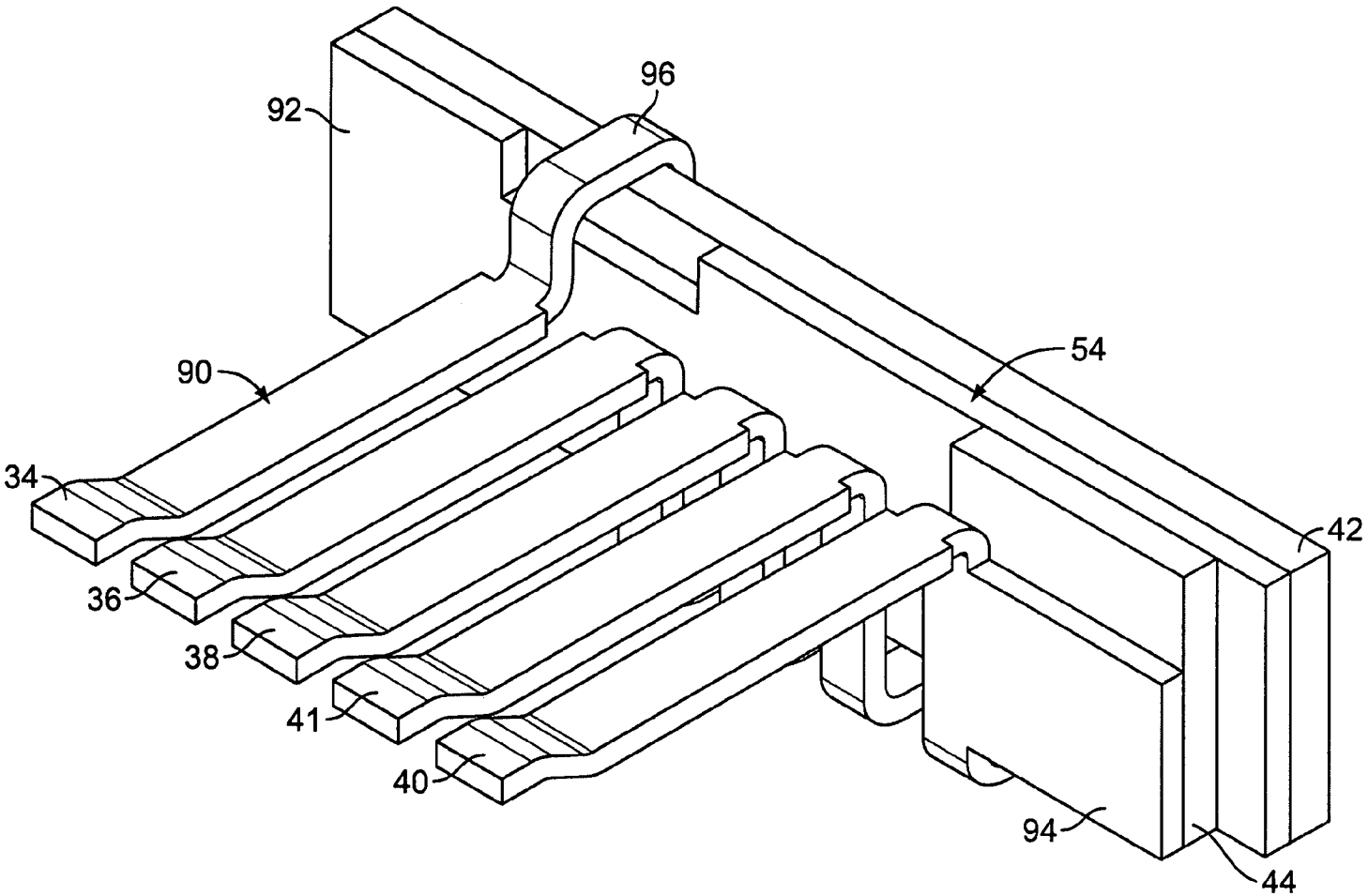
FIG. 4 is a downward orthogonal view showing one preferred form of a pin, connector and lead array of the FIG. 2 socket structure.
Figure 5:
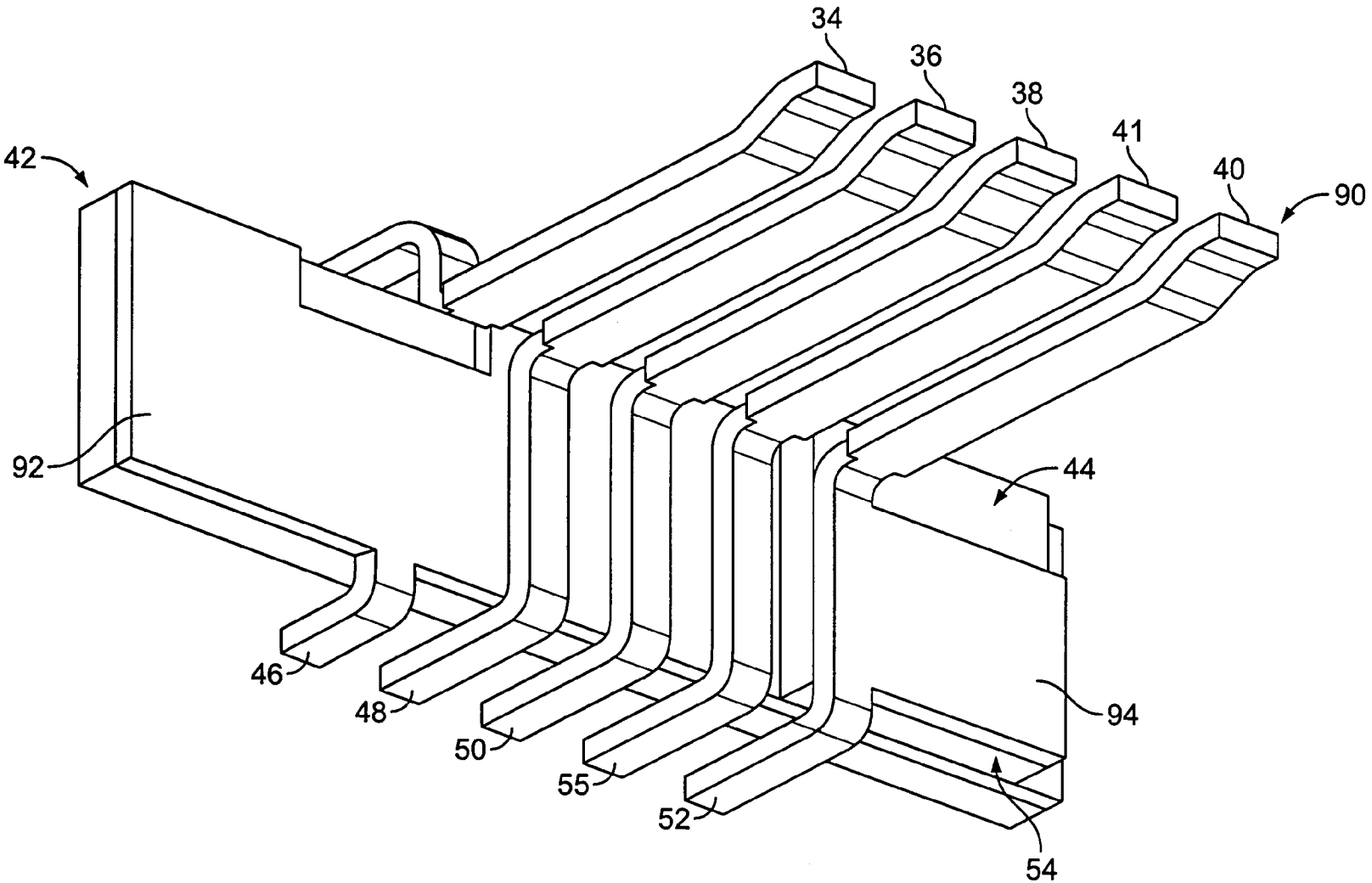
FIG. 5 is an upward orthogonal view of the FIG. 4 pin, connector and lead array.
Figure 6:
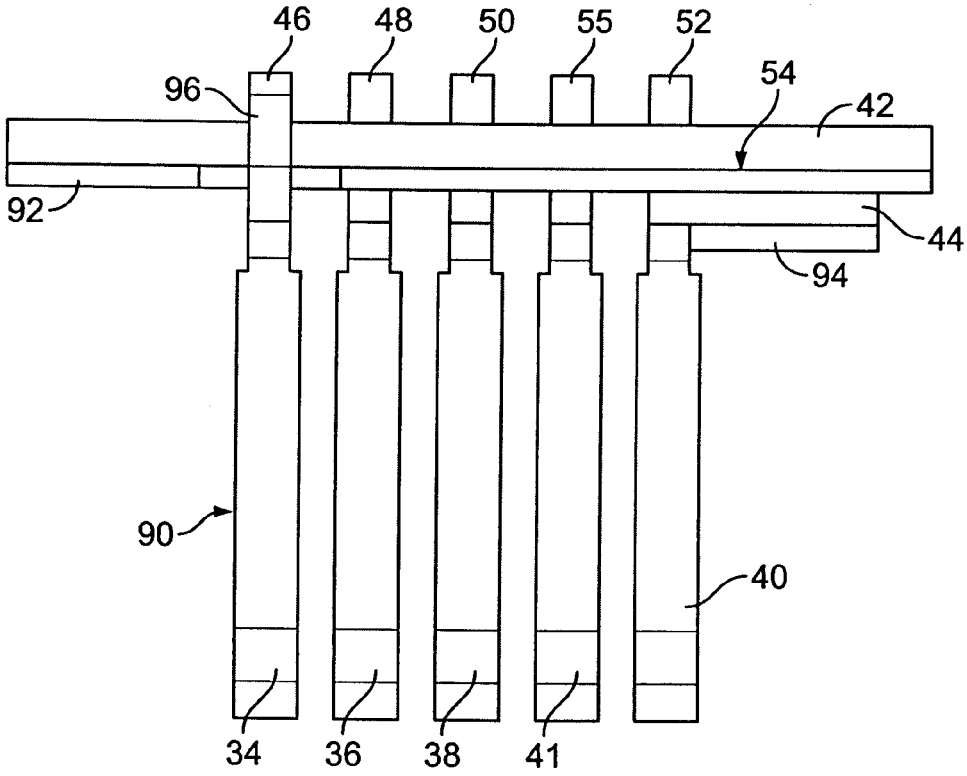
FIG. 6 is a top plan view of the FIGS. 4 and 5 pin, connector and lead array, showing an over-voltage protection element mounted on one side of a transverse heat spreading plate, and an over-current protection element mounted on an opposite side of the transverse heat spreading plate.

FIGS. 4, 5, 6 and 7 illustrate an example of a pin, connector and lead array 90 as including segments defining pins 34, 36, 38, 41 and 40, and also defining a transverse heat spreading and transfer plate 92 which connects directly to lead 46, a ground return plate segment 94 extending from the pin 40 and lead 52, and a connection segment 96 extending from the pin 34. As shown in the FIGS. 4 and 5 embodiment, the over-voltage protection element 44 is sandwiched between (and connected to) the ground plate segment 94 and a front side of the transverse heat spreading plate 92, whereas the over-current protection element 42 is mounted and connected to a back side of the transverse heat spreading plate 92 and is also connected to the connection segment 96. The plate segment 94 includes a portion aligned with ground return lead 52, while the connection segment 96 is formed as part of, and is aligned with, pin 34 (as seen in FIG. 5). Transverse plate 92 is formed with and is directly connected to the lead 46, thus electrically connecting the PPTC thermistor current protection element 42 in series between pin 34 and lead 46 (as diagrammed in FIG. 1). In the present example the transverse heat spreading and transfer plate 92 forms the heat transfer medium 54 directly between the over-voltage element 44 and the adjacent portion of the over-current element 42. In this particular arrangement, the plate 92 also functions to spread the heat over a greater area of the over-current PPTC thermistor element 42, thereby facilitating more rapid tripping to its high resistance, circuit protective state.

A sacrificial bridging web (not shown in FIGS. 4 and 5) most preferably connects the pins 34-41 along the front of the lead pin array 90, and another sacrificial bridging web interconnects the leads 46-55 at the rear end of the array 90 in order to maintain alignment of the pin, connector and lead array 90 prior to overmolding of the plastic body 28. These sacrificial bridging webs of a lead frame forming the contact pin array 90 are sheared off and discarded as part of the manufacturing process after injection molding of the plastic body is complete. The connector pin array 90 is most preferably die formed or stamped from a suitable metal substrate, such as 0.3 mm phosphor bronze, nickel silver, or other suitable metal sheet material, and then coated with a suitable coating material such as tin.

Figure 7:
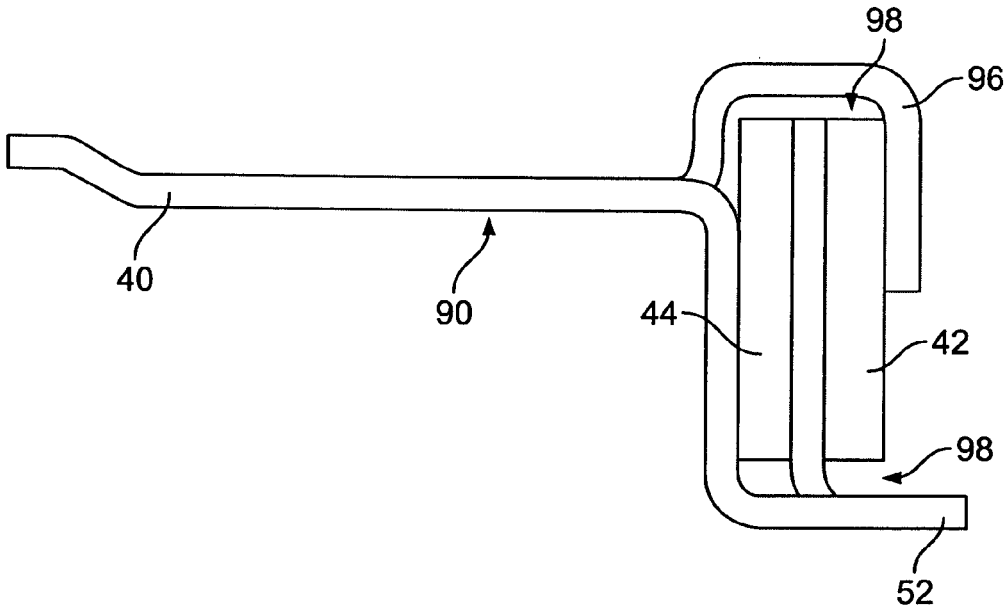
FIG. 7 is a right side view in elevation of the FIGS. 4 and 5 pin, connector and lead array showing relative placements of the over-voltage protection element, the transverse pin-array plate, and the over-current protection element.
Figure 8:
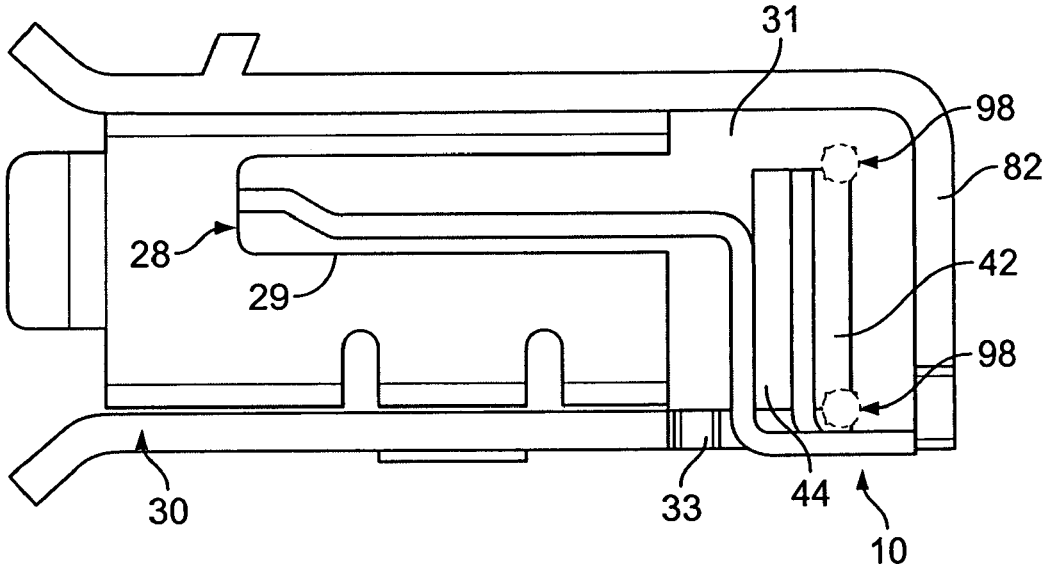
FIG. 8 is a side view in elevation and section of the FIG. 2 assembled socket structure taken along a section line 7-7 in FIG. 2.
Figure 9:
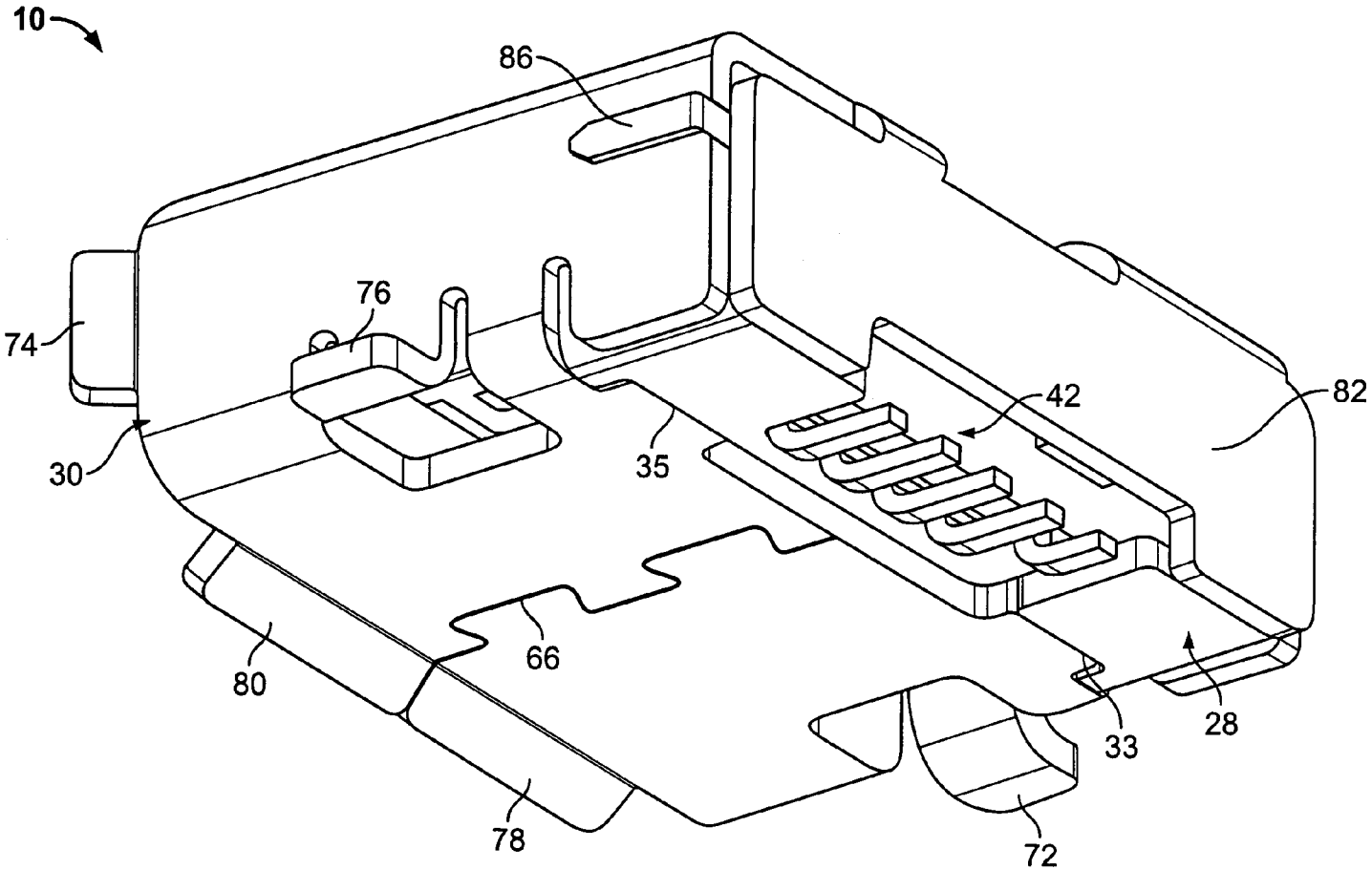
FIG. 9 is an orthogonal view in upward projection, showing the bottom side segments, right side and rear side of the outer shell of the FIG. 2 socket structure together with surface mount contact pin extensions.

FIG. 7 and the FIG. 8 sectional view show a peripheral space 98 that is provided between the edges of the over-current element 42 and the adjacent molded plastic body 28. This peripheral space 98 enables the over-current element 42, particularly when implemented as a PPTC thermistor, to expand in the tripped state without being impeded by the plastic body 28. FIG. 9 shows the completed socket assembly 10 and illustrates the back wall 82 and other features of the shell 30 and plastic body 28.

Figure 10:
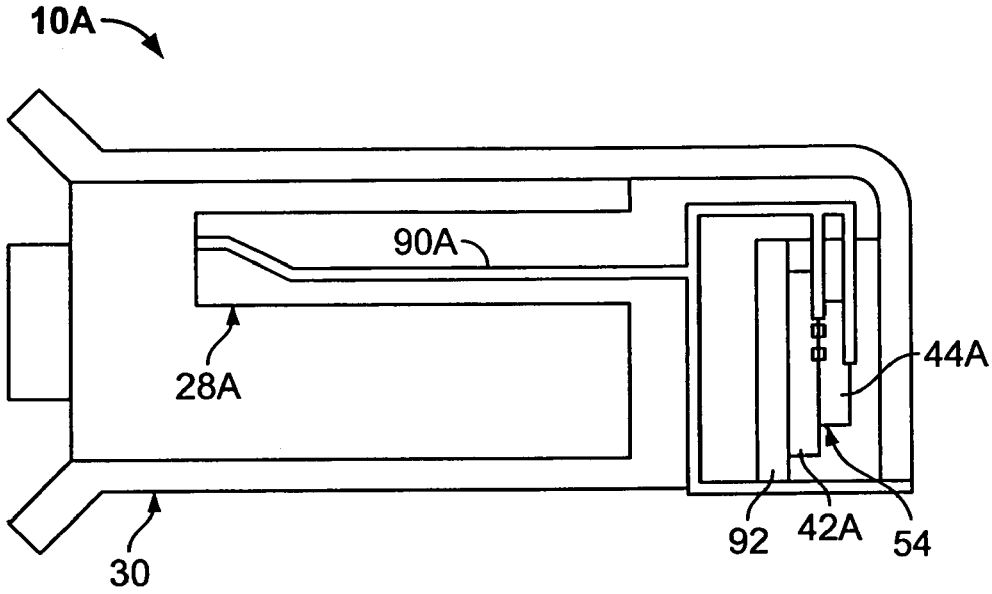
FIG. 10 is a cutaway side assembly view in elevation of an alternative preferred Micro-B USB connector socket structure in accordance with principles of the present invention, wherein the over-current protection element is sandwiched between the transverse heat spreading plate and the over-voltage protection element.
Figure 11:
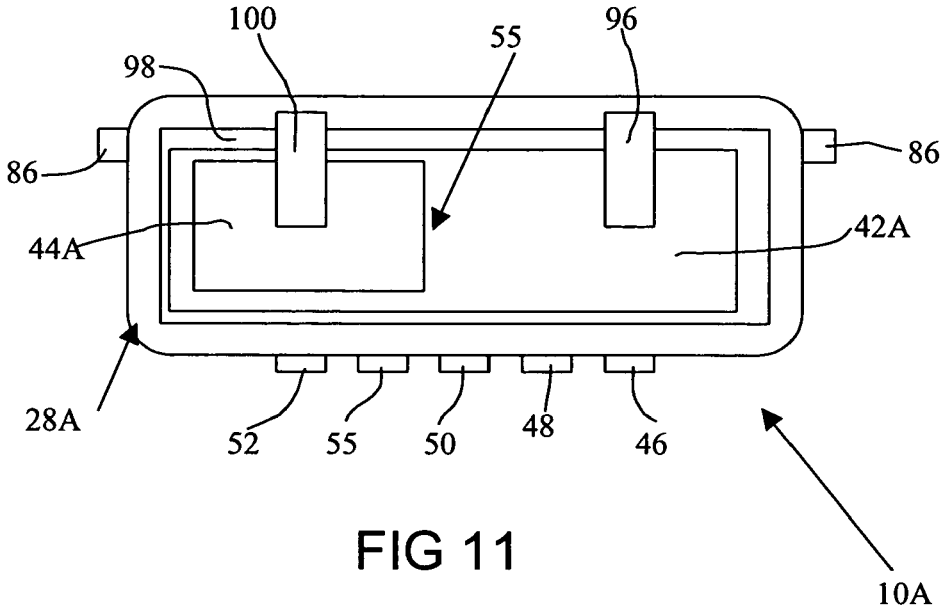
FIG. 11 is an enlarged rear view in elevation of the molded plastic body of the FIG. 10 alternative socket structure.

FIGS. 10 and 11 illustrate an alternative form of Micro-B USB connector socket 10A embodying principles of the present invention. Elements which are the same as described for socket 10 have the same reference numerals and description. In this alternative arrangement, the over-current and over-voltage protection elements 42A and 44A are formed as an integrated hybrid electronics circuit module which is premade and tested, and then attached to the back side of the lead pin array plate 92. FIG. 10 also illustrates the peripheral channel or space 98 separating the PPTC thermistor 42 from the adjacently facing inside walls of the molded plastic body 28A. In this arrangement the over-voltage protection element 44A is in direct thermal and electrical contact with the PPTC thermistor element 42A, thereby providing thermal transfer to accelerate trip of the PPTC thermistor 42A during an over-voltage/over-current event. Details concerning fabrication and assembly of a hybrid electronic circuit module comprising a zener diode in thermal and electrical contact with a PPTC thermistor are set forth in commonly assigned U.S. patent application Ser. No. 11/392,974 (Montoya et al.) filed on Mar. 27, 2006 , and entitled "Surface Mount Multi-layer Electrical Circuit Protection Device With Active Element Between PPTC Layers" (Now U.S. Publication No. 2006/0215342A1 published on Sep. 28, 2006), the disclosure thereof being expressly incorporated herein by reference thereto.

Following formation of the plastic body 28A, the hybrid electronic circuit module comprising elements 42A and 44A is inserted into the recess space at the back and electrically connected thereto as by bonding a terminal electrode of the PPTC thermistor component 42A to form the connection to pin 34 to the transverse plate 92, and then bending connection segments 96 and 100 respectively over and into contact position with aligned connection regions of the PPTC thermistor component 42A and the zener diode component 44A, respectively, as shown in FIG. 11. The connection section 96 is then electrically connected to the PPTC thermistor component 42A by a suitable bonding agent, such as low temperature solder, and forms the common node connection between the PPTC thermistor 42 and the cathode of the zener diode 44A leading to the connection lead 46. The connection section 100 is likewise electrically connected to e.g. an anode electrode connection of the zener diode 44 and internally connected to the ground return lead 52. The completed plastic body assembly 28A is then ready for insertion into and inclusion within the outer metal shell 30 of the socket 10A. After the body assembly 28A is inserted into the formed metal shell 30, the back side 82 is folded down to lock the assembly 28 in place within the completed socket, as shown in FIG. 8, for example.

Figure 12:
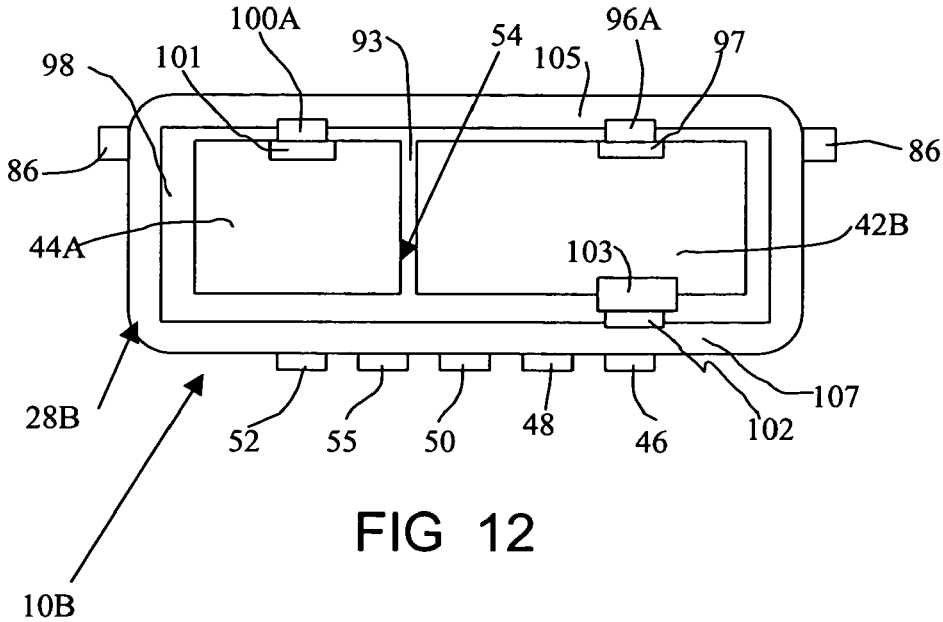
FIG. 12 is an enlarged rear view in elevation of an alternative preferred Micro-B USB connector socket structure in accordance with principles of the present invention, wherein the over-current protection element is in a side-by-side arrangement with the over-voltage protection element, and wherein both protection elements are mounted to a common heat transfer plate and are electrically connect at edge connection pads to aligned pads of the socket structure.

Alternatively, as shown in the FIG. 12 embodiment of a socket 10B in accordance with principles of the present invention, the over-voltage protection element 44A and the over-current protection element 42B are arranged in a side-by-side configuration and mounted to a heat transfer and mounting plate 93 providing a lateral heat transfer medium 54 and providing a hybrid subassembly. In this embodiment of the present invention the molded plastic body 28B is formed to provide conductor segments 96A and 100A extending inwardly from an inside face of a molded top wall region 105 of the plastic body 28B defining the recess for receiving the over-current and over-voltage protection hybrid subassembly. A third conductor segment 102 extends inwardly from an inside face of a molded bottom wall region 107 of the plastic body 28B. The conductor segment 96A is aligned with, and connected to, pin 34; and the conductor segment 102 is aligned with, and connected to, lead 46. The conductor segment 100A is aligned and connected in common with ground return pin 40 and lead 52. Edge connector pads 97 and 103 are formed at opposite edges of the over-current protection element 42B, with pad 97 aligning with conductor segment 96A, and with pad 103 aligning with conductor segment 102. A pad 101 formed at an edge of the over-voltage protection element 44A enables a ground return connection to be made, e.g. to an anode electrode of a zener diode. The arrangement shown in FIG. 12 enables the assembled hybrid electronics circuit module to be inserted into the recess defined by molded plastic body 28B and electrically connected by solder bridges between segment 96A and pad 97, between segment 100A and pad 101, and between segment 102 and pad 103, without any need for bending pins as was used in the FIGS. 10 and 11 example. In the example of FIG. 12, pad 103 is also connected to the heat transfer and mounting plate 93 which forms a common electrical connection between elements 42B and 44A.

Advantageously, the alternative sockets 10A and 10B enable usage of a circuit protection module comprising e.g. a PPTC thermistor element and e.g. a zener diode. The module may be separately made, assembled and pretested as a hybrid electronics circuit module prior to inclusion within the structure of the socket 10A or socket 10B.

In making the miniaturized socket of the present invention, the pin, connector and lead array 90 is formed out a sheet of suitable contact material by stamping or die forming. In the case of the first preferred embodiment, the over-voltage protection element, e.g. zener diode 44, is then positioned between and respective surface electrode terminals secured to plates 92 and 94, as shown in FIGS. 4 and 5. Then, the over-current protection element, e.g. PPTC thermistor 42 may be secured to an opposite face of the elongate transverse plate 92 forming the common node connection between the cathode of the zener diode 44 and the PPTC thermistor 42. The connection segment 96 may then be secured to and bonded to the non-common electrode of the PPTC thermistor 42. The plastic body 28 is then formed by injection-molding over the completed lead frame 90, with mold features ensuring the provision of the peripheral channel 98 to accommodate dimensional expansion of the PPTC thermistor 42 when operating in its tripped and thermally expanded state. Any sacrificial alignment features of the lead frame connector pin array 90 remaining following the molding step are then cut off, e.g., by a shearing operation. Also, the completed plastic body assembly 28 may then receive a thin protective corrosion-resistant overcoat. After the sheet metal shell 30 is stamped out and partially folded into its final shape, the completed plastic body 28 assembly is inserted into the shell and locked in place by folding down the rear wall 82 thereof.

The alternative embodiment connector socket 10A is similarly made with the exception that the lead frame 90A is formed with connection segments extending laterally to enable the over-current/over-voltage circuit module to be separately attached. The plastic body 28A is injection-molded around the lead frame 90A and any sacrificial alignment features are removed. Then, the electronic module is installed by connecting the non-common one of the PPTC thermistor's electrodes to the plate 92A. Then connection segments 96 and 100 are bent around the hybrid electronics module and connected to the common electrode between the PPTC thermistor component 42A and the cathode of the zener diode component 44A, and the anode electrode of the zener diode component 44A, respectively. The completed plastic body assembly 28A may then receive a thin protective corrosion-resistant overcoat and is then ready for insertion into the partially completed metal shell 30, and completion of the socket 10A as described above.

The alternative embodiment connector socket 10B employs edge connection pads formed on the zener diode 44A and the PPTC thermistor 42A and connected directly to pins, as shown in the referenced U.S. Publication No. 2006/0215342A1, without the need for bending over the connection segments 96 and 100 as shown in FIG. 10. In this particular example, the pin, connector and lead array is formed without the transverse heat spreading plate 92, since that function is provided by the heat transfer and mounting plate 93 of the hybrid electronics circuit module.

Those skilled in the art will appreciate that connection segment 96 is aligned vertically with connection lead 46, and connection segment 100 is aligned vertically with connection lead 52 as shown in the elevational view of FIG. 11. This geometric arrangement efficiently utilizes the space within the available footprint or envelope of the standard connector socket, so that the sockets 10, 10A and 10B affording over-voltage and over-current protection element, may be directly substituted for compliant standard sockets without these circuit protection capabilities.

While the present invention has been illustrated as embodied in an exemplary Micro-B, USB, connector socket, those skilled in the art will appreciate that over-current/over-voltage circuit protection elements and modules may be included in other forms of connectors, whether plugs, sockets, or both, and whether conforming to a standard or being a unique design. In particular, the present invention is directly applicable to the standardized Mini-B USB connector socket and enables a fully compatible, drop-in replacement or substitution for a Mini-B USB connector socket not including integrated over-voltage and over-current protection elements. Moreover, the present invention may employ a variety of over-voltage circuit protection elements beyond zener diodes, and may employ a variety of over-current circuit protection elements, including for example ceramic positive temperature coefficient thermistor devices, as well as polymeric positive temperature coefficient thermistor devices, for example.

Having thus described preferred embodiments of the invention, it will now be appreciated that the objects of the invention have been fully achieved, and it will be understood by those skilled in the art that many changes in construction and widely differing embodiments and applications of the invention will suggest themselves without departing from the spirit and scope of the invention. Therefore, the disclosures and descriptions herein are purely illustrative and are not intended to be in any sense limiting.

What is claimed is:

1. A miniature Universal Serial Bus (USB) electrical connector comprising:

(a) a plurality of discrete connector leads including at least a power supply and a power return lead and at least one data signal lead, each lead including a connector pin portion at one end and circuit connection portion at an opposite end;

(b) a plastic body encapsulating unexposed portions of the plurality of discrete connector leads and including a positive temperature coefficient resistive over-current circuit protection element connected in series with the power supply lead to form a supply side portion and a load side portion, and an electronic over-voltage circuit protection element connected in shunt across the load side portion of the power supply lead and the power return lead, wherein the electronic over-voltage circuit protection element is also in thermal contact with the resistive over-current circuit protection element such that heat generated in the electronic over-voltage circuit protection element accelerates operation of the resistive over-current circuit protection element; and, (c) a metal shell surrounding at least a portion of the plastic body and registering the plastic body in a predetermined alignment.

2. The miniature USB electrical connector set forth in claim 1 comprising a connector socket, and wherein the metal shell surrounds substantially the entirety of the plastic body and wherein the plastic body defines mounting features for registering with corresponding mounting features of the metal shell, thereby aiding in registering the plastic body in predetermined alignment relative to the metal shell.

3. The miniature USB electrical connector set forth in claim 2 further comprising mounting features of the shell and circuit connection portions of the plurality of discrete connector leads for defining a surface-mountable and connectable connector socket.

4. The miniature USB electrical connector set forth in claim 1 wherein the plurality of discrete connector leads comprises a first transverse connection plate forming a mounting substrate for the resistive over-current circuit protection element, the first transverse connection plate comprising a common electrical connection between the resistive over-current circuit protection element and the electronic over-voltage circuit protection element, and wherein the plurality of discrete connector leads comprises a second transverse connection plate spaced away from, and substantially parallel to, the first transverse connection plate thereby forming a space for receiving, holding and connecting the electronic over-voltage circuit protection element and for providing thermal contact between the electronic over-voltage circuit protection element and the resistive over-current circuit protection element.

5. The miniature USB electrical connector set forth in claim 1 wherein the positive temperature coefficient resistive over-current circuit protection element comprises a polymeric positive temperature coefficient (PPTC) thermistor, and wherein the plastic body forms a well around the PPTC thermistor including a peripheral channel accommodating thermal expansion of the PPTC thermistor during over-current circuit protection operation.

6. The miniature USB electrical connector set forth in claim 5 wherein the electronic over-voltage circuit protection element is mounted directly to a major surface of the PPTC thermistor opposite to the first transverse connection plate and comprises a zener diode having a cathode electrode electrically connected to the load side portion of the power supply lead.

7. The miniature USB electrical connector set forth in claim 1 wherein the plastic body includes an elongated neck portion extending from a generally rectangular body portion, the elongated neck portion exposing connector pin portions of the plurality of discrete connector leads, and the generally rectangular body portion exposing connection lead segments of the plurality of discrete connector leads and defining a recess for receiving and surrounding at least the resistive over-current circuit protection element, the recess defining a peripheral channel accommodating thermal expansion of the over-current circuit protection element during over-current circuit protection operation.

8. The miniature USB electrical connector set forth in claim 7 wherein the resistive over-current circuit protection element and the electronic over-voltage circuit protection element comprise a hybrid electronic circuit module having an electrical and thermal conduction plate connected to the load side portion of the power supply lead, and wherein the recess contains the hybrid circuit module.

9. The miniature USB electrical connector set forth in claim 8 wherein the resistive over-current circuit protection element and the electronic over-voltage circuit protection element are arranged side-by-side on the electrical and thermal conduction plate of the hybrid circuit module.

10. An electrical surface-mountable connector socket in conformance with a Universal Serial Bus (USB) standard governing connector sockets, the connector socket comprising an array of formed and aligned discrete conductor leads including a power supply lead, a power return lead, at least two data differential signal leads, and an extra lead, each lead including a connector pin portion at one end and a circuit connector portion at an opposite end, the connector socket further including a plastic body encapsulating unexposed portions of the plurality of discrete conductor leads and including an over-current circuit protection element and an over-voltage circuit protection element, the over-current circuit protection element comprising a polymeric positive temperature coefficient (PPTC) thermistor connected in series with the power supply lead to form a supply side portion and a load side portion and the over-voltage circuit protection element comprising a zener diode connected in shunt across the load side portion of the power supply lead and the power return lead being in thermal contact with the over-current circuit protection element in order to accelerate heating thereof to a tripped state during a circuit protection event, the connector socket further including a metal shell surrounding and registering substantially all of the plastic body to register the plastic body in a predetermined alignment.

11. The connector socket set forth in claim 10 further comprising a first transverse mounting plate and a second transverse mounting plate with the zener diode being mounted between the first and second mounting plates and with the PPTC thermistor being mounted on an opposite side of the first transverse mounting plate exposed within a well defined by the plastic body, wherein the first transverse plate provides thermal coupling between the zener diode and the PPTC thermistor, and wherein the well defines a peripheral channel surrounding the PPTC thermistor to provide room for thermal expansion occurring during an over-current event.

12. The connector socket set forth in claim 10 further comprising a transverse electrical and thermal conduction plate in a well defined by the plastic body, and wherein the PPTC thermistor is combined with the zener diode as a hybrid electronic module and mounted to the single transverse electrical and thermal conduction plate in the well.

13. The connector socket set forth in claim 12 further comprising a plurality of conductive segments exposed along inside wall surfaces of a well defined by the plastic body, and wherein the PPTC thermistor and the zener diode are mounted to the transverse electrical and thermal conduction plate and define connection pads aligned with and connected respectively to the plurality of conductive segments.

14. A miniature electrical connector socket in conformance with a predetermined standard governing Universal Serial Bus (USB) connector sockets, the connector socket comprising an array of formed and aligned discrete conductor pins and associated connection leads in a predetermined specified geometric arrangement, the connector socket further comprising a plastic body encapsulating unexposed portions of the plurality of discrete conductor pins and associated connection leads and having structural features in accordance with the predetermined standard, the connector socket further comprising a metal shell surrounding substantially all of the plastic body and engaging with features of the plastic body to register the plastic body in an alignment specified by the standard, the plastic body forming a housing for surrounding, holding and connecting a positive temperature coefficient resistive over-current circuit protection element and an electronic over-voltage circuit protection element, the resistive over-current circuit protection element being connected in series between a pin and a lead of a first one of the plurality of discrete conductor pins and associated leads, and the electronic over-voltage circuit protection element being connected in parallel across said lead of said first one, and across a pin and lead of a second one of the plurality of discrete conductor pins and associated leads, the electronic over-voltage circuit protection element being thermally coupled to the resistive over-current circuit protection element in order to accelerate heating thereof to a tripped state during an over-voltage/over-current event of a circuit in which the connector is a component part.

15. The miniature electrical connector set forth in claim 14 wherein the electronic over-voltage circuit protection element is a zener diode and wherein the positive temperature coefficient resistive over-current protection element is a polymeric positive temperature coefficient (PPTC) thermistor.

16. The miniature electrical connector set forth in claim 15 wherein the zener diode and the PPTC thermistor are mounted to a transverse heat transfer plate which forms a common electrical connection node connecting to the lead of the first one of the plurality of discrete conductor pins, the transverse heat transfer plate being located in a well formed by the plastic body within the housing, the well including a peripheral channel accommodating thermal expansion of the PPTC thermistor during over-current circuit protection operation.

17. The miniature electrical connector set forth in claim 16 wherein the zener diode, PPTC thermistor and transverse heat transfer plate comprise a hybrid electronics circuit module for inclusion within the well.

18. The miniature electrical connector set forth in claim 17 wherein the zener diode and the PPTC thermistor are mounted on one side of the transverse heat transfer plate within the well.

19. The miniature electrical connector set forth in claim 16 wherein the zener diode is mounted in the housing on one side of the transverse heat transfer plate and wherein the PPTC thermistor is mounted on an opposite side of the transverse heat transfer plate within the well of the housing.

20. The miniature electrical connector set forth in claim 14 comprising a surface-mountable electrical connector socket in accordance with a Universal Serial Bus standard governing Micro-B connector sockets; wherein the first one of the plurality of discrete conductor pins and associated leads comprises a power supply pin; wherein the second one of the plurality of discrete conductor pins and associated leads comprises a power return and ground lead; and, wherein the leads of the plurality of discrete conductor pins and associated leads are oriented in parallel to provide surface mounting and connection of the connector socket to aligned trace pads of a printed circuit board substrate.

* * * * *